US006648263B2

(12) United States Patent
Monterulo et al.

(10) Patent No.: US 6,648,263 B2
(45) Date of Patent: Nov. 18, 2003

(54) DYNAMIC TENSIONING FOR WIRE-WINDING DEVICE

(75) Inventors: Lawrence C. Monterulo, Yonkers, NY (US); Valdislav Cichra, Harrison, NY (US)

(73) Assignee: Semx Corporation, Armonk, NY (US)

( * ) Notice: Subject to any disclaimer, the term of this patent is extended or adjusted under 35 U.S.C. 154(b) by 72 days.

(21) Appl. No.: 10/004,606

(22) Filed: Oct. 27, 2001

(65) Prior Publication Data

US 2003/0080232 A1 May 1, 2003

(51) Int. Cl.[7] ..... B65H 59/02; B65H 18/26
(52) U.S. Cl. ..... 242/421.7; 242/147 M
(58) Field of Search ..... 242/417.3, 421.7, 242/147 M, 155 M

(56) References Cited

U.S. PATENT DOCUMENTS 2,006,819 A * 7/1935 Zschach ..... 242/420.6
2,605,055 A * 7/1952 Scott et al. ..... 242/411
3,962,595 A * 6/1976 Eddens ..... 310/93
4,381,852 A * 5/1983 Ferree et al. ..... 242/421.7
4,526,329 A * 7/1985 Takeda ..... 242/155 M
5,092,534 A * 3/1992 Tanaka ..... 242/155 M
5,100,074 A * 3/1992 Jones ..... 242/420.6
5,642,865 A * 7/1997 Fell et al. ..... 242/334.6
6,527,216 B2 * 3/2003 Eagelman et al. ..... 242/417.3

FOREIGN PATENT DOCUMENTS

JP 401321244 A * 12/1989 ..... 242/421.7

* cited by examiner

*Primary Examiner*—Michael R. Mansen
(74) *Attorney, Agent, or Firm*—Henri J. A. Charmasson; John D. Buchaca

(57) ABSTRACT

A tension-regulated wire-feeding apparatus, particularly adapted to high speed winding of thin conductor wires upon an electronic component, applies a magnetic particle brake to the wire supply spool in inverse proportion to the pulling tension applied on the wire by the winding mechanism. The brake is controlled by an electric current generated by a controllable power supply. The output of the power supply is modulated by a follower potentiometer coupled to a lever arm which resiliently bear against a segment of wire unwound from the supply spool in order to monitor its pulling tension.

5 Claims, 2 Drawing Sheets

DYNAMIC TENSIONING FOR WIRE-WINDING DEVICE

FIELD OF THE INVENTION

This invention relates to wire-winding apparatuses used, among others, in the field of electrical and electronic component manufacture; and more particularly, to wire tension regulating devices.

BACKGROUND OF THE INVENTION

The manufacture of transformers, chokes, wire-resistors, solenoids and other forms of inductive components requires a supply of electric wire from a supply spool at a constant pulling tension regardless of variations in the winding speed. The miniaturization of components call for the use of extremely fine wires while ever-increasing winding speed are sought in order to reduce production time and cost. In order to maintain the regularity and evenness of the winding, the tension of the wire must be kept constant regardless of the acceleration and deceleration of the winding equipment and the fluctuation in the diameter of the component being wound.

The prior art has provided various types of mechanical wire tension regulators consisting essentially of a modulable brake applied to the wire-feeding spool and controlled by a mechanical linkage to a tension-sensing lever mounting pulley engaging the wire. The inertia inherent to such a mechanical system causes a brake lag that results in slackening of the wire during deceleration, or sudden tension during acceleration of the winding process. The former can lead to irregularity in the winding sequences. The latter can cause a fracture, or a stretching of the wire that can compromise the accuracy of the wound electrical component.

SUMMARY OF THE INVENTION

The principal and secondary objects of this invention are to provide a tension-regulated wire-feeding apparatus suitable for the manufacture of transformers, chokes, resistors, solenoids and other inductance components at a high winding speed using a relatively thin conducting wire where the tension of the wire is precisely regulated during acceleration and deceleration phases at the beginning and end of the component manufacture as well as changes in the radius of the feeding spool or the wound component.

These and other valuable objects are achieved by applying an electronic negative feed-back signal to a magnetic particle brake acting upon the wire supply spool. The feed-back signal of very low hysteresis and a negligible inertia is generated by a current supply modulated by the output of a potentiometer coupled to a wire tension-sensing oscillating arm.

DESCRIPTION OF THE PREFERRED EMBODIMENT OF THE INVENTION

Figure 1:
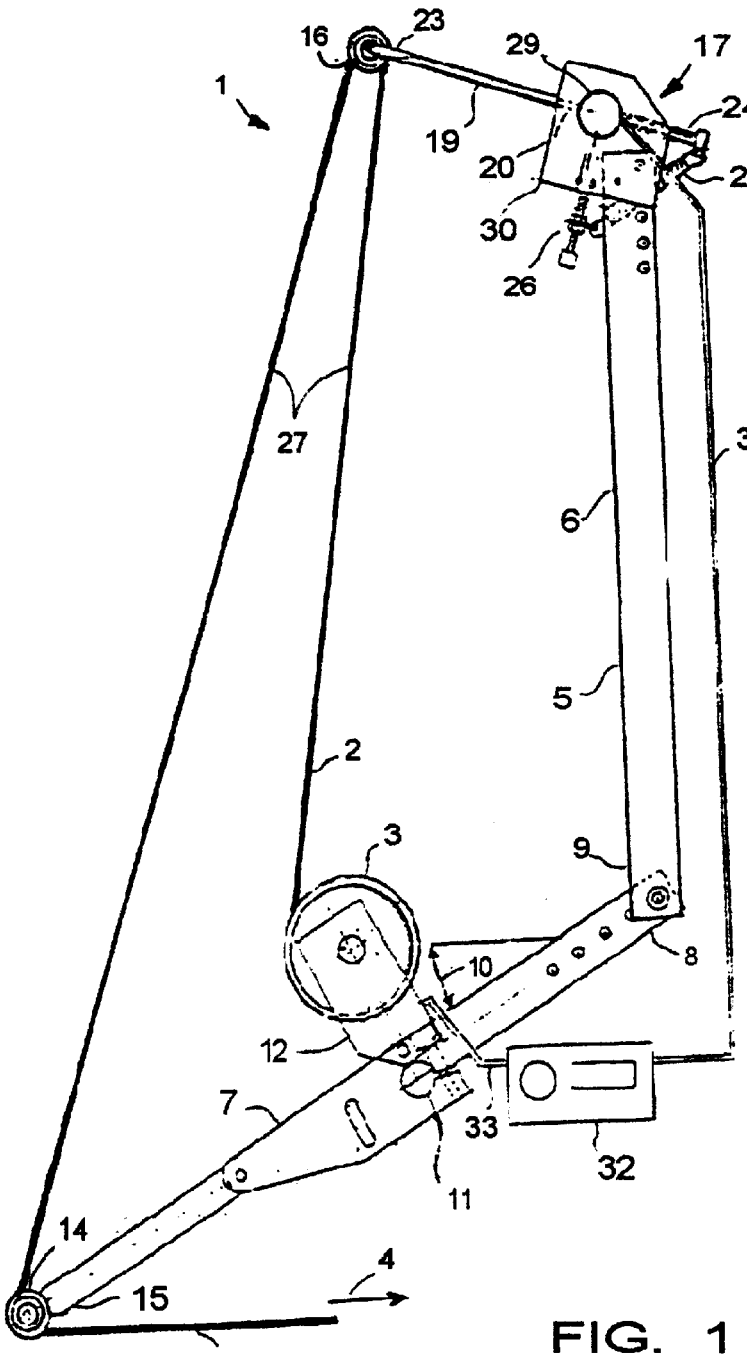
FIG. 1 is a side elevational view of the dynamic tensioning wire-feeding apparatus.
Figure 2:
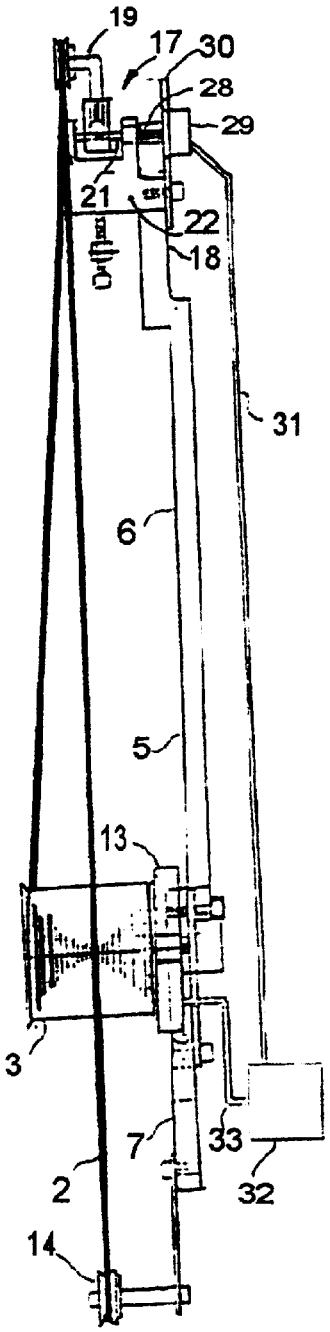
FIG. 2 is a front elevational view thereof.
Figure 3:
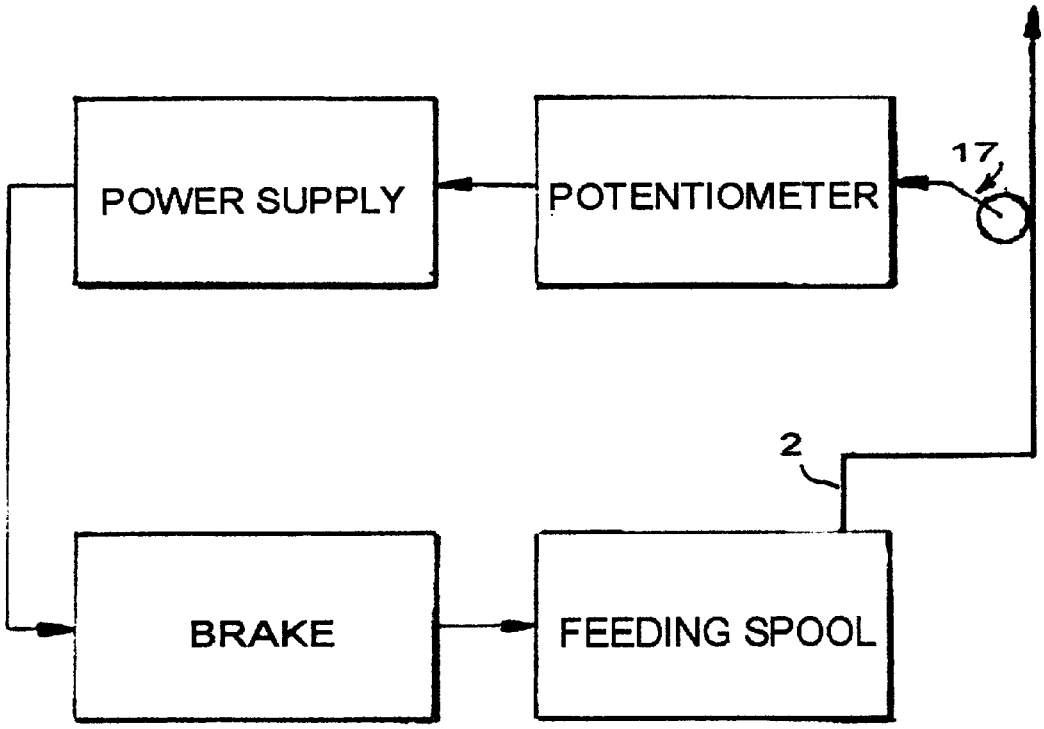
FIG. 3 is an operational block diagram thereof.

Referring now to the drawing, there is shown a dynamic tension-regulated wire feeding apparatus 1 according to the invention. The apparatus is designed to maintain a constant tension on a wire 2 being unwound from a wire-feeding spool 3 under sudden and rapid variations of the speed at which the wire is pulled out of the spool as indicated by the arrow 4. The apparatus is particularly adapted to the precision winding of electronic components.

The various elements of the apparatus are supported by a framework comprising a first vertical beam 5 whose median portion 6 can be conveniently secured to a wall, bench or other supporting structure. A second beam 7 has a proximal portion 8 fixedly attached to the proximal portion 9 of the first beam and projects obliquely and downwardly therefrom at an angle 10 of approximately 30 degrees with the horizon.

In lieu of or in addition to the securing of the first beam to a supporting structure, the median portion 11 of the second beam can be attached to it.

Secured to the median portion 11 of the second beam, is a mounting structure 12 that rotatively supports the wire-feeding spool 3 and a magnetic particle brake 13 which is applied to the spool. The wire 2 unwound from the spool 3 rides upon a free-spinning pulley 14 mounted at the distal portion 15 of the second beam 7 from where it is pulled by the electronic component manufacturing assembly which is not shown on the drawing.

Between the feeding spool 3 and the first pulley 14, the wire 2 is engaged by a second free-spinning pulley 16 associated with a tension-sensing oscillating lever assembly 17 mounted at the distal or upper portion 18 of the first beam 5.

The oscillating lever assembly comprises a rod 19 whose median section 20 is secured to a shaft 21 rotatively supported by a bearing structure 22. The second pulley 16 is mounted on the distal section 23 of the rod. The opposite or proximal section 24 of the rod is resiliently biased downward by an extensible coil spring 25 secured at its opposite end to the lower part of the bearing structure 22 by way of a length-adjustable linking mechanism 26. Accordingly, the second pulley 16 is resiliently biased against that segment 27 of the wire between the feeding spool 3 and the first pulley 14. The rod 19 and second pulley 16 tend to oscillate in response to variations in the tension of the wire 2. The resilient biasing of the rod and second pulley, that is the torque it deflectively applies to the wire can be conveniently set by adjusting the tension of the spring 25 through the length adjustable linking mechanism 26. The shaft 21 which acts as the fulcrum for the rod 19 is coupled to the axle 28 of a follower potentiometer 29 which is fixedly attached to a plate 30 associated with the bearing structure 22. A first wire harness 31 applies the output of the potentiometer 29 to the control terminals of an adjustable, constant current power supply 32. A second wire harness 33 applies the output current of the power supply to the magnetic particle brake 13. The output terminals of the potentiometer 29 are connected to increase the current out of the power supply 32 when the distal section of the rod 19 and the second pulley move upward, that is away from the feeding spool 3 and first pulley 14 as a result of a slackening, that is a reduction of tension of the wire 2. The rising current out of the power supply 32 increases the friction of the brake 13, slowing down the spinning of the feeding spool 3. As the tension of the wire is increased by the braking action upon the feeding spool, the distal section of the rod and the second pulley have a tendency to move downward, that is toward the feeding spool and the first pulley, inverting the rotational movement of the potentiometer 29. The current out of the power supply 32 is consequently decreased, causing a reduction of the braking action upon the spool.

When the oscillating lever assembly is properly balanced, that is when the tension of the spring 25 is close to matching the tension of the wire 2, the feedback system that controls the brake 13 has a very low mechanical inertia. This low inertia coupled with the rapid response of the constant current power supply 32 to the signal generated by the potentiometer 39 yields a very precise control of the pulling tension of the wire 2 during acceleration and deceleration of the electronic component assembly at the beginning end of its manufacturing cycle as well as during pulling changes due to variations in the diameter, or the path of the electronic components being wound as well as change to the diameter of the feeding spool as the wire is taken from it.

In this preferred embodiment of the invention, the follower potentiometer 29 is a 500 Ohms model P1-1. The magnetic particle brake 13 is a model B5Z, and the power supply 32 is model PS-24-MCF. All these electronic components are commerically available from Placid Industries, Inc. of Lake Placid, N.Y.

The apparatus is particularly effective in connection with wires having a diameter under 75 microns (0.003 inch) being unwound from the feeding spool at speeds up to approximately 100 meters (350 feet) per minute.

It should be noted that the rotational direction of the feeding spool 3 is irrelevant to the operation of the tension-regulating system.

For best results, the lengths of each of the first beam 5 and second beam 7 is approximately 30 centimeters (12 inches), the distance between the axis of the feeding spool 3 and the first pulley 14 is approximately 16 centimeters (6.25 inches), the distance between the first pulley 14 and the second pulley 16 is approximately 48 centimeters (19 inches) and the distance between the second pulley 16 and the oscillating lever assembly shaft 21 is approximately 8 centimeters (3.25 inches).

While the preferred embodiments of the invention have been described, modifications can be made and other embodiments may be devised without departing from the spirit of the invention and the scope of the appended claims.

What is claimed is:

1. A tension-regulated wire-feeding apparatus which comprises:

a fixed, free-spinning first pulley;

a wire-feeding spool distal from said first pulley;

a supply of wire wound on said spool and having an end-segment riding on said first pulley;

an oscillating lever deflectively bearing against said segment at a point between said spool and said first pulley;

means for resiliently biasing said lever against said segment;

a current-modulable electrical brake mechanism coupled to said spool;

a voltage-controlled current supply source applied to said brake mechanism; and a potentiometer coupled to said lever and having its output voltage applied to said current supply source;

whereby a movement of said lever caused by a slackening of said segment generates a negative feed-back braking effect upon said spool via said potentiometer and current source;

wherein said lever comprises:

a bearing structure;

a shaft rotatively held by said bearing structure;

a rod having a proximal section, a median section and a distal section;

said rod being secured to said shaft about said median section;

a free-spinning second pulley secured to said distal section and being engaged by said segment; and wherein said means for resiliently biasing comprises an extensible coil spring having a first end attached to said proximal section and an opposite second end attached to said bearing structure.

2. The apparatus of claim 1, wherein said potentiometer comprises an axle coupled to said shaft.

3. The apparatus of claim 2, which further comprises means for adjusting the tension of said coil spring.

4. The apparatus of claim 3, wherein said means for adjusting comprise an adjustable linking mechanism mounted at one end of said coil spring.

5. The apparatus of claim 3, which further comprises:

a framework including a first beam and a second beam obliquely projecting from said first beam;

each of said beams having a proximal portion, a median portion, and a distal portion wherein said proximal portions are joined together;

said bearing structure being secured to the distal end of said first beam;

a mounting structure holding said spool secured to the median portion of said second beam; and said first pulley being secured to the distal portion of said second beam;

whereby said wire segment extends from said spool toward and around said second pulley, then toward and around said first pulley.

* * * * *